US009915451B2

(12) United States Patent
Christians et al.

(10) Patent No.: US 9,915,451 B2
(45) Date of Patent: Mar. 13, 2018

(54) LEVEL CONTROL IN AN EVAPORATOR

(71) Applicant: Carrier Corporation, Farmington, CT (US)

(72) Inventors: Marcel Christians, Skaneateles, NY (US); Jack Leon Esformes, Jamesville, NY (US); Satyam Bendapudi, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 14/768,756

(22) PCT Filed: Dec. 10, 2013

(86) PCT No.: PCT/US2013/074047

§ 371 (c)(1),
(2) Date: Aug. 18, 2015

(87) PCT Pub. No.: WO2014/130139

PCT Pub. Date: Aug. 28, 2014

(65) Prior Publication Data

US 2015/0377527 A1 Dec. 31, 2015

Related U.S. Application Data

(60) Provisional application No. 61/766,349, filed on Feb. 19, 2013.

(51) Int. Cl.
*F25B 39/02* (2006.01)
*F28D 21/00* (2006.01)
(Continued)

(52) U.S. Cl.
CPC ..... *F25B 39/02* (2013.01); *F25B 39/028* (2013.01); *F25B 2339/0242* (2013.01);
(Continued)

(58) Field of Classification Search
CPC ..... F25B 39/028; F25B 2339/0242; F25B 2600/2515; F25B 2700/04; F28F 25/02; F28D 5/02; F28D 2021/0071
(Continued)

(56) References Cited

U.S. PATENT DOCUMENTS 2,596,036 A * 5/1952 MacDougall ..... F25B 39/028 137/509
3,828,567 A 8/1974 Lesczynski
(Continued)

FOREIGN PATENT DOCUMENTS

CN 1259198 A 7/2000
CN 152911 A 9/2004
(Continued)

OTHER PUBLICATIONS

Notification of the International Search Report and the Written Opinion of the International Searching Authority; PCT/U52013/074047; European Patent Office; Mailed Feb. 24, 2014; ISR 4 pages; WO 6 pages.
(Continued)

*Primary Examiner* — Emmanuel Duke
(74) *Attorney, Agent, or Firm* — Cantor Colburn LLP

(57) ABSTRACT

A heating, ventilation and air-conditioning (HVAC) a falling film evaporator in flow communication with a condenser. The falling film evaporator includes a separator to separate vapor from liquid refrigerant and a plurality of evaporator tubes through which a volume of thermal energy transfer medium is flowed. A distribution system is operably connected to the separator to distribute a flow of liquid refrigerant over the plurality of evaporator tubes. A primary feed conduit delivers a flow of refrigerant to the separator, and at least one secondary feed conduit is in flow communication with the primary feed conduit. At least one auxiliary valve
(Continued)

is located at the secondary feed conduit to regulate flow into the separator from the primary feed conduit. At least one sensor senses a level of a refrigerant pool in the evaporator. The sensor is operably connected to the at least one auxiliary valve to control operation thereof.

16 Claims, 3 Drawing Sheets

(51) Int. Cl.
*F28F 25/02* (2006.01)
*F28D 5/02* (2006.01)

(52) U.S. Cl.
CPC ... *F25B 2600/2515* (2013.01); *F25B 2700/04* (2013.01); *F28D 5/02* (2013.01); *F28D 2021/0071* (2013.01); *F28F 25/02* (2013.01)

(58) Field of Classification Search
USPC ..... 62/115
See application file for complete search history.

(56) References Cited

U.S. PATENT DOCUMENTS

| | | | | |
|---|---|---|---|---|
| 4,551,983 | A | 11/1985 | Atsumi et al. | |
| 5,136,855 | A | 8/1992 | Lenarduzzi | |
| 5,431,026 | A | 7/1995 | Jaster | |
| 5,515,694 | A | 5/1996 | Meloling et al. | |
| 5,600,962 | A | 2/1997 | Aizawa et al. | |
| 5,761,914 | A * | 6/1998 | Carey | F25B 1/047 62/157 |
| 6,035,651 | A * | 3/2000 | Carey | F04C 28/06 62/115 |
| 6,230,517 | B1 | 5/2001 | Ishiguro et al. | |
| 6,266,964 | B1 * | 7/2001 | Meyer | F04B 39/0207 137/392 |
| 6,293,112 | B1 * | 9/2001 | Moeykens | F25B 39/02 165/115 |
| 2008/0148767 | A1 | 6/2008 | De Larminat et al. | |
| 2009/0178790 | A1 * | 7/2009 | Schreiber | F25B 39/028 165/158 |
| 2011/0023515 | A1 | 2/2011 | Kopko et al. | |
| 2012/0117992 | A1 | 5/2012 | Yang | |

FOREIGN PATENT DOCUMENTS

| | | | |
|---|---|---|---|
| CN | 200943981 | Y | 9/2007 |
| CN | 101052854 | A | 10/2007 |
| CN | 201196503 | Y | 2/2009 |
| CN | 201344692 | Y | 11/2009 |
| CN | 201740327 | U | 2/2011 |
| CN | 202092383 | U | 12/2011 |
| CN | 202371944 | U | 8/2012 |
| DE | 4238531 | A1 | 2/1994 |
| EP | 0843139 | A2 | 5/1998 |
| WO | 9857104 | | 12/1998 |
| WO | 03064940 | | 8/2003 |

OTHER PUBLICATIONS

State Intellectual Property Office of People's Republic China Search Report; Application No. 201380073336.4; Dated Sep. 14, 2016.

* cited by examiner

LEVEL CONTROL IN AN EVAPORATOR

BACKGROUND

The subject matter disclosed herein relates to heating, ventilation and air conditioning (HVAC) systems. More specifically, the subject matter disclosed herein relates to evaporators for HVAC systems.

HVAC systems, such as chillers, use an evaporator to facilitate a thermal energy exchange between a refrigerant in the evaporator and a medium flowing in a number of evaporator tubes positioned in the evaporator. In a flooded evaporator, the tubes are submerged in a pool of refrigerant. In the flooded evaporator system, compressor guide vanes and system metering tools control a total rate of refrigerant circulation through the system. The specific requirement of maintaining an adequate refrigerant level in the pool is achieved by merely maintaining a level of charge, or total volume of refrigerant in the system.

Another type of evaporator used in chiller systems is a falling film evaporator. In a falling film evaporator, the evaporator tubes are positioned typically below a distribution manifold from which refrigerant is urged, forming a "falling film" on the evaporator tubes. The falling film terminates in a refrigerant pool at a bottom of the falling film evaporator. On advantage of a falling film evaporator is typically the use of a lower amount of refrigerant charge compared to a flooded evaporator system. One challenge with falling film evaporators, however, is maintaining an adequate refrigerant level in the refrigerant pool, while still achieving the savings in refrigerant utilized.

BRIEF SUMMARY

In one embodiment, a heating, ventilation and air conditioning (HVAC) system includes a condenser flowing a flow of refrigerant therethrough and a falling film evaporator in flow communication with the condenser. The falling film evaporator includes a plurality of evaporator tubes through which a volume of thermal energy transfer medium is flowed. A distribution system distributes a flow of liquid refrigerant over the plurality of evaporator tubes. A primary feed conduit delivers a flow of refrigerant to the evaporator, and at least one secondary feed conduit is in flow communication with the primary feed conduit. At least one auxiliary valve is located at the secondary feed conduit to regulate flow into the evaporator from the primary feed conduit. At least one sensor senses a level of a refrigerant pool in the evaporator. The sensor is operably connected to the at least one auxiliary valve to control operation thereof.

In another embodiment, an evaporator system for a heating ventilation and air conditioning (HVAC) system includes a plurality of evaporator tubes through which a volume of thermal energy transfer medium is flowed. A distribution system distributes a flow of liquid refrigerant over the plurality of evaporator tubes. A primary feed conduit delivers a flow of refrigerant to the evaporator and at least one secondary feed conduit is in flow communication with the primary feed conduit. At least one auxiliary valve is located at the secondary feed conduit to regulate flow into the separator from the primary feed conduit and at least one sensor senses a level of a refrigerant pool in the evaporator. The sensor is operably connected to the at least one auxiliary valve to control operation thereof.

In yet another embodiment, a method of regulating flow of refrigerant to an evaporator system for a heating ventilation and air conditioning (HVAC) system includes flowing the refrigerant through a primary feed conduit toward the evaporator system. At least a portion of the refrigerant is flowed into a secondary feed conduit arranged in parallel to the primary feed conduit. A refrigerant level in a refrigerant pool of the evaporator is sensed and the flow of refrigerant through the secondary feed conduit and into the evaporator via the primary feed conduit is regulated based on the sensed refrigerant level.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

Figure 1:
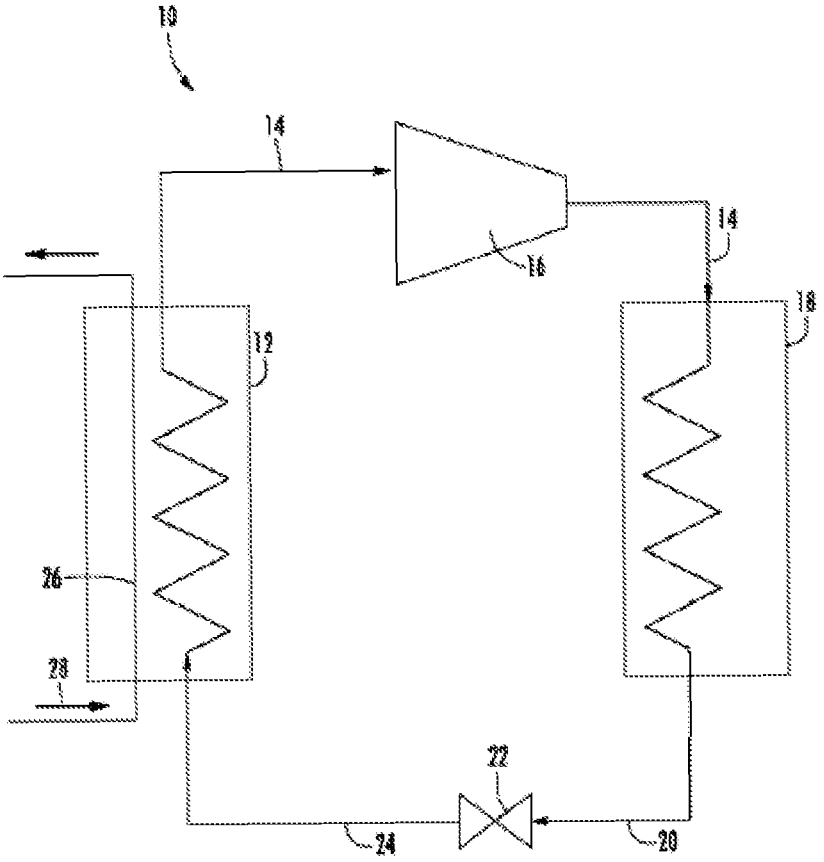
FIG. 1 is a schematic view of an embodiment of a heating, ventilation and air conditioning system.

The detailed description explains embodiments of the invention, together with advantages and features, by way of example with reference to the drawing.

DETAILED DESCRIPTION

Shown in FIG. 1 is a schematic view an embodiment of a heating, ventilation and air conditioning (HVAC) unit, for example, a chiller 10 utilizing a falling film evaporator 12. A flow of vapor refrigerant 14 is directed into a compressor 16 and then to a condenser 18 that outputs a flow of liquid refrigerant 20 to an expansion valve 22. The expansion valve 22 outputs a vapor and liquid refrigerant mixture 24 to the evaporator 12. A thermal energy exchange occurs between a flow of heat transfer medium 28 flowing through a plurality of evaporator tubes 26 into and out of the evaporator 12 and the vapor and liquid refrigerant mixture 24. As the vapor and liquid refrigerant mixture 24 is boiled off in the evaporator 12, the vapor refrigerant 14 is directed to the compressor 16.

Figure 2:
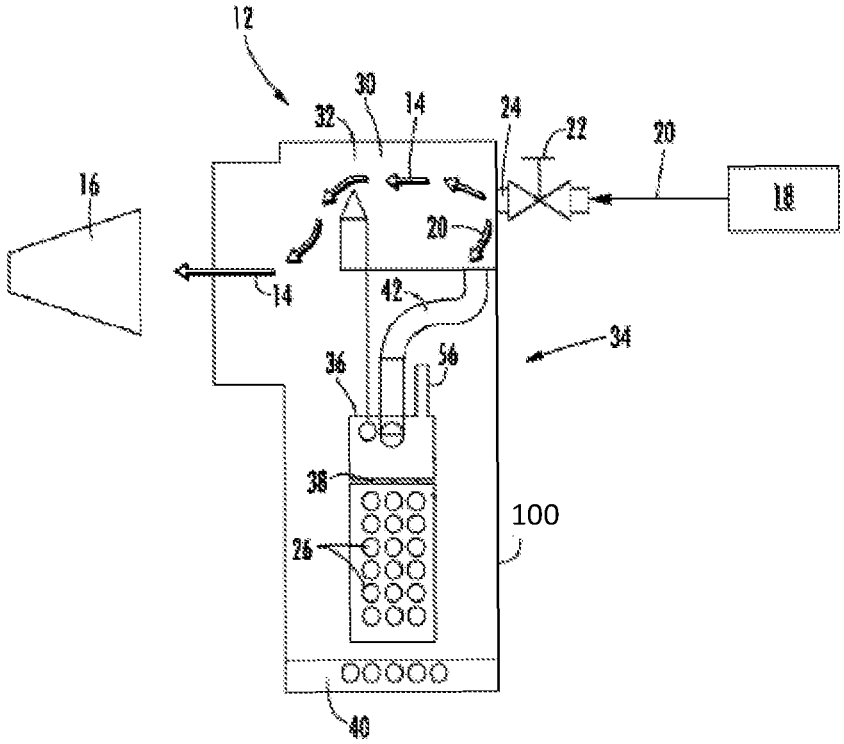
FIG. 2 is a schematic view of an embodiment of a falling film evaporator for an HVAC system.

Referring now to FIG. 2, as stated above, the evaporator 12 is a falling film evaporator. The evaporator 12 includes housing 100 with the evaporator 12 components disposed at least partially therein, including a separator 30 to separate liquid refrigerant 20 and vapor refrigerant 14 from the vapor and liquid refrigerant mixture 24. Vapor refrigerant 14 is routed from the separator 30 through a suction port 32 and toward the compressor 16, while the liquid refrigerant 20 is routed toward a distribution system 34 of the evaporator 12. The distribution system 34 includes a distribution box 36 having a plurality of drip openings 38 arrayed along a bottom surface of the distribution box 36. Though in the embodiment of FIG. 2 the distribution box 36 is substantially rectangular in cross-section, it is to be appreciated that the distribution box 36 may have another cross-sectional shape, for example, T-shaped or oval shaped. The distribution box 36 and drip openings 38 are configured to drip liquid refrigerant 20 onto evaporator tubes 26 and resulting in the falling film terminating in a refrigerant pool 40 at a bottom of the evaporator 12. A feed pipe 42 extends from the separator 30 into the distribution box 36 and terminates in the distribution box 36.

Figure 3:
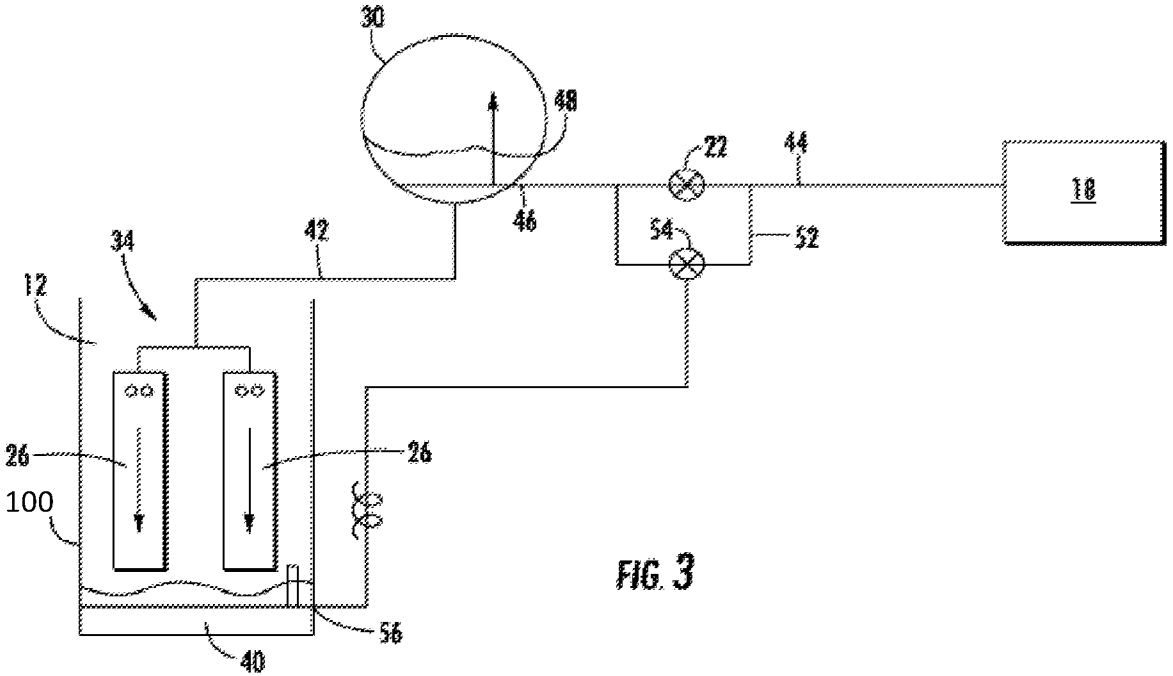
FIG. 3 is a schematic view of a level control for an embodiment of a falling film evaporator for an HVAC system.

Referring to FIG. 3, flow from the expansion valve 22 into the separator 30 is via a primary feed conduit 44 with a feed outlet 46 that is, in some embodiments, below a separator refrigerant level 48. The expansion valve 22 is a self metering device that self adjusts based on pressure in the primary feed conduit 44 upstream and downstream of the expansion valve 22. It is to be appreciated that the expansion valve 22 may include electronic expansion valve, thermostatic expansion valve, capillary tube, or other types of self-metering device. A secondary feed conduit 52 branches from the primary feed conduit 44 upstream of the expansion valve 22 and reconnects to the primary feed conduit 44 downstream of the expansion valve 22. The secondary feed conduit 52 includes an auxiliary valve 54 to meter flow through the secondary feed conduit 52. The auxiliary valve 54 is not, however, self-adjusting, but is connected to a level meter 56 in the evaporator 12 that senses the level of refrigerant in the refrigerant pool 40. In some embodiments, the level meter 56 is a float, but other types of level meters 56, for example, mechanical, electronic, or optical devices, such as capacitive sensors, may be used. An increased level of refrigerant in the refrigerant pool 40 detected by the level meter 56, in some instances exceeding an upper threshold, results in the auxiliary valve 54 moving towards a closed position reducing a flow through the secondary feed conduit 52. A decreased level of refrigerant in the refrigerant pool 40 detected by the level meter 56, in some instances below a lower threshold, results in the auxiliary valve 54 moving towards a open position increasing a flow through the secondary feed conduit 52.

During normal, nominal operation of the evaporator 12, both the expansion valve 22 and the auxiliary valve 54 are at least partially open, so flow proceeds through both the primary feed conduit 44 and the secondary feed conduit 52. The primary feed conduit 44 and the expansion valve 22 are sized to handle a majority of the flow while, depending on the refrigerant level in the refrigerant pool 40, the auxiliary valve 54 can be opened to increase flow into the separator 30, and thus increase flow rate into the refrigerant pool 40 to raise its level. Similarly, the auxiliary valve 54 can be closed to decrease flow into the separator 30 and likewise flow into the refrigerant pool 40 thus lowering its level.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A heating, ventilation and air conditioning (HVAC) system comprising:

a condenser flowing a flow of refrigerant therethrough;

a falling film evaporator in flow communication with the condenser including:

a plurality of evaporator tubes through which a volume of thermal energy transfer medium is flowed;

a distribution system to distribute a flow of liquid refrigerant over the plurality of evaporator tubes; and a primary feed conduit to deliver a flow of refrigerant to the evaporator;

an expansion valve disposed along the primary feed conduit, the expansion valve configured to move between an opened and closed position;

at least one secondary feed conduit in flow communication with the primary feed conduit;

at least one auxiliary valve disposed at the secondary feed conduit to regulate flow into the evaporator from the primary feed conduit; and at least one sensor to sense a level of a refrigerant pool in the evaporator, the sensor operably connected to the at least one auxiliary valve, wherein the at least one auxiliary valve is configured to be moved between an opened position and a closed position in response to the sensed level of the refrigerant pool in the evaporator.

2. The HVAC system of claim 1, wherein the secondary feed conduit is arranged in parallel relationship with the primary feed conduit.

3. The HVAC system of claim 1, further comprising a self-regulating flow control device disposed at the primary feed conduit.

4. The HVAC system of claim 3, wherein the self regulating flow control device is one of an electronic expansion valve, thermostatic expansion valve or capillary tube.

5. The HVAC system of claim 1, wherein the at least one sensor is at least one float or at least one capacitive sensor.

6. The HVAC system of claim 1, wherein under nominal operating conditions, refrigerant flows through both the primary feed conduit and the secondary feed conduit.

7. The HVAC system of claim 1, wherein the evaporator includes a separator to separate vapor refrigerant from a liquid-vapor refrigerant mixture.

8. An evaporator system for a heating ventilation and air conditioning (HVAC) system comprising:

a plurality of evaporator tubes through which a volume of thermal energy transfer medium is flowed;

a distribution system to distribute a flow of liquid refrigerant over the plurality of evaporator tubes; and a primary feed conduit to deliver a flow of refrigerant to the evaporator;

an expansion valve disposed along the primary feed conduit, the expansion valve configured to move between an opened and dosed position;

at least one secondary feed conduit in flow communication with the primary feed conduit;

at least one auxiliary valve disposed at the secondary feed conduit to regulate flow into the evaporator from the primary feed conduit; and at least one sensor to sense a level of a refrigerant pool in the evaporator, the sensor operably connected to the at least one auxiliary valve, wherein the at least one auxiliary valve is configured to be moved between an opened position and a closed position in response to the sensed level of the refrigerant pool in the evaporator.

9. The evaporator system of claim 8, wherein the secondary feed conduit is arranged in parallel relationship with the primary feed conduit.

10. The evaporator system of claim 8, further comprising a self-regulating flow control device disposed at the primary flow conduit.

11. The evaporator system of claim 10, wherein the self regulating flow control device is one of an electronic expansion valve, thermostatic expansion valve or capillary tube.

12. The evaporator system of claim 8, wherein the at least one sensor is at least one float or at least one capacitive sensor.

13. The evaporator system of claim 8, wherein under nominal operating conditions, refrigerant flows through both the primary feed conduit and the secondary feed conduit.

14. A method of regulating flow of refrigerant to an evaporator system for a heating ventilation and air conditioning (HVAC) system comprising:

flowing the refrigerant through a primary feed conduit toward a separator of the evaporator system;

regulating the flow of refrigerant through the primary feed conduit via an expansion valve disposed along the primary feed conduit, the expansion valve configured to move between an opened and dosed position;

flowing at least a portion of the refrigerant into a secondary feed conduit arranged in parallel to the primary feed conduit;

sensing a refrigerant level in a refrigerant pool of the evaporator; and regulating the flow of refrigerant through the secondary feed conduit and into the separator via the primary feed conduit in response to the sensed refrigerant level.

15. The method of claim 14, further comprising regulating the flow through the primary feed conduit via one of an electronic expansion valve, thermostatic expansion valve or capillary tube.

16. The method of claim 14, wherein sensing the refrigerant level is performed by a float or a capacitive sensor in the refrigerant pool.

* * * * *